US006164463A

United States Patent [19]

Lee

[11] Patent Number: 6,164,463

[45] Date of Patent: Dec. 26, 2000

[54] TOOL DISPLAY RACK

[76] Inventor: Jack Lee, No. 53, Nan-Shi Keng, Dan-Nan Village, Mei-Shan Hsiang, Chia-Yi Hsien, Taiwan

[21] Appl. No.: 09/431,372

[22] Filed: Nov. 1, 1999

[51] Int. Cl.[7] ..... A47F 7/00; B65D 85/00

[52] U.S. Cl. ..... 211/70.6; 206/376; 206/464; 206/481

[58] Field of Search ..... 211/70.6, 4, 54.1; 206/349, 376, 377, 477, 464, 481, 482; 248/222.11, 222.12

[56] References Cited

U.S. PATENT DOCUMENTS

| | | | |
|---|---|---|---|
| 3,533,511 | 10/1970 | Giampa | 211/57.1 |
| 4,598,958 | 7/1986 | Verholt | 312/189 |
| 5,713,467 | 2/1998 | Kao | 206/349 |
| 5,785,187 | 5/1999 | Lipman et al. | 211/59.1 |
| 5,819,932 | 10/1998 | Norbits | 206/349 |
| 5,906,350 | 5/1999 | Kao | 248/688 |
| 5,941,386 | 8/1999 | Hu et al. | 206/376 |
| 5,988,381 | 11/1999 | Ling | 206/349 |
| 5,996,817 | 12/1999 | Kao | 211/70.6 |

*Primary Examiner*—Daniel P. Stodola
*Assistant Examiner*—Gregory J. Strimbu
*Attorney, Agent, or Firm*—Charles E. Baxley

[57] ABSTRACT

A tool display rack includes a board having a slot and two apertures defined therethrough. A U-shaped retaining member including a bridge member and two insertions is connected to the board by engaging the two insertions with the two apertures of the board so that a tool can be retained by the U-shaped retaining member. The bridge member has two grooves defined therein so that the bridge member can be cut at the two grooves into two parts to allow the tool to be disengaged from the two parts. Each aperture is enclosed by a wall member which extends from the board. Each insertion has a hole which is engaged with a ridge extending from each wall member.

3 Claims, 10 Drawing Sheets

TOOL DISPLAY RACK

FIELD OF THE INVENTION

The present invention relates to a display rack, and more particularly, to a tool display rack which has a U-shaped retaining member and a limitation member on the rack so as to retain a tool on the rack.

BACKGROUND OF THE INVENTION

A conventional tool display rack 11 is shown in FIG. 10 and generally includes a slot and/or two apertures 10 for hanging the rack with a tool retained on the rack 11. A plurality of retaining members 12 extend from a surface of the rack 11 and each retaining member 12 has a notch 13 so as to force-fit the tool in the notch 13. Although the conventional tool display rack allow the customer to observe the appearance of the tool displayed, the tool is not secured to the rack 11 so that the tool might be taken from the rack without permission by taking the tool from the notch 13. Furthermore, after the tool is purchased, the rack 11 will be discarded because the display rack is useless.

The present invention intends to provide a tool display rack that has a retaining member and a limitation member. A tool is secured on the display rack and the retaining member can be cut into two parts after the tool and the rack are purchased so that the tool is removably engaged with the two parts.

SUMMARY OF THE INVENTION

In accordance with one aspect of the present invention, there is provided a tool display rack comprising a board having a slot and two apertures respectively defined therein. A U-shaped retaining member is connected to the board, wherein the retaining member includes a bridge member and two insertions extending from the bridge member. The two insertions are engaged with the two apertures of the board, and the bridge member has two grooves defined therein.

The primary object of the present invention is to provide a tool display rack wherein the outer appearance of the tool retained on the rack is completely visible and the tool cannot be taken from the display rack except cutting the retaining member.

Another object of the present invention is to provide a tool display rack which has a limitation member and a retaining member so as to retain tools having different shapes.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
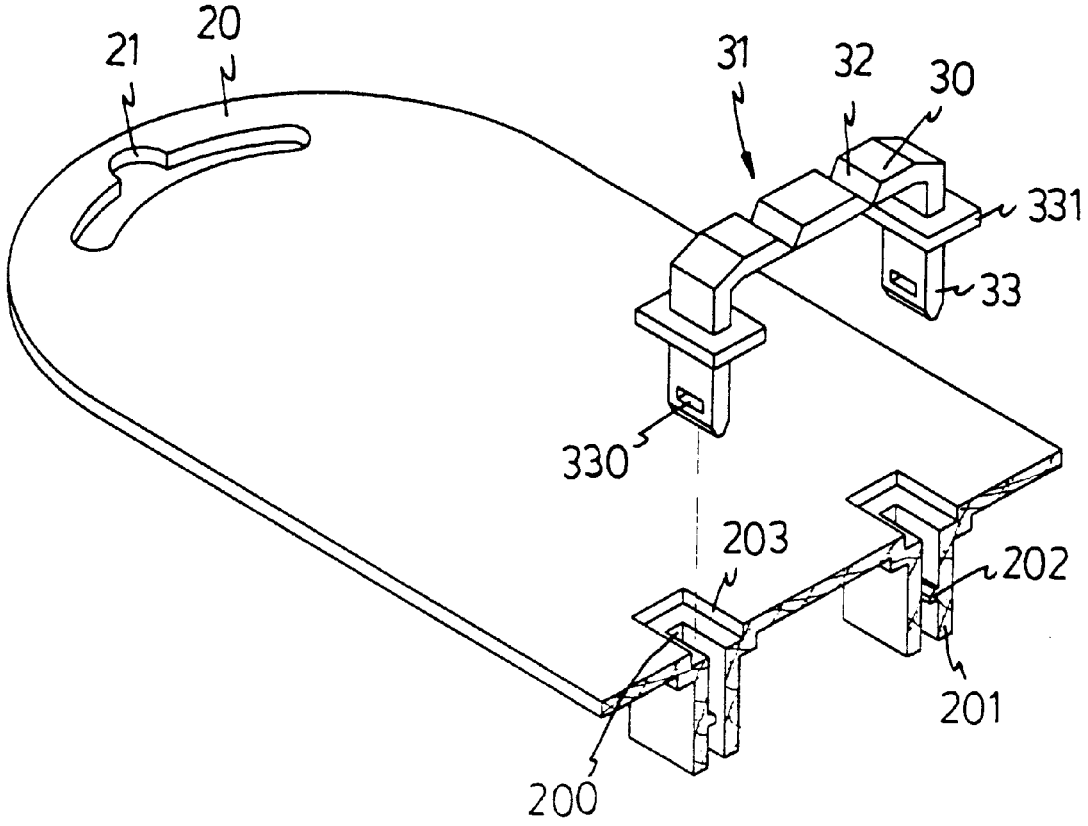
FIG. 1 is a cross-sectional view to show a retaining member and a board of the tool display rack in accordance with the present invention.
Figure 2:
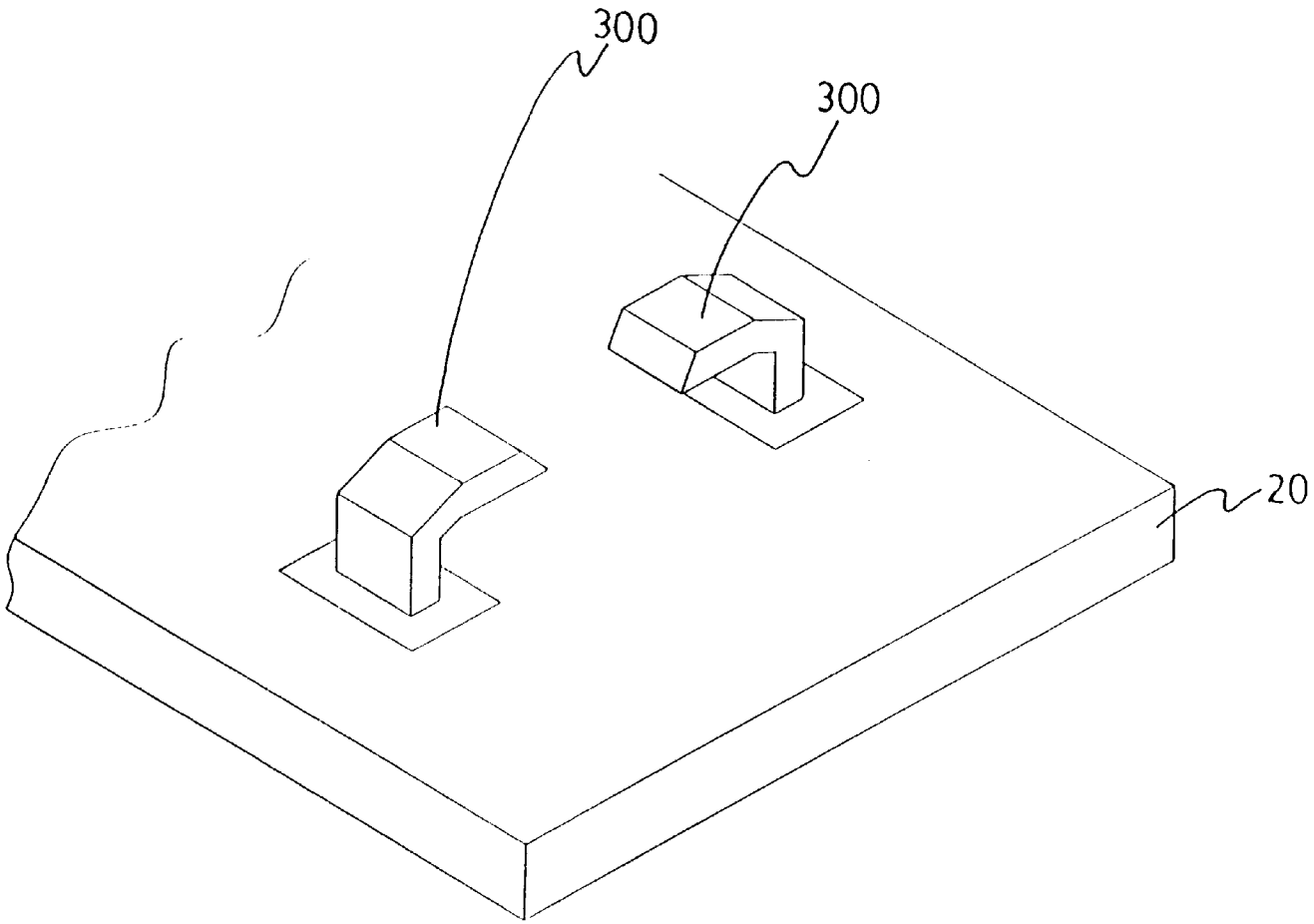
FIG. 2 is an illustrative view to show the bridge member of the retaining member of the present invention is cut into two parts on the board.
Figure 3:
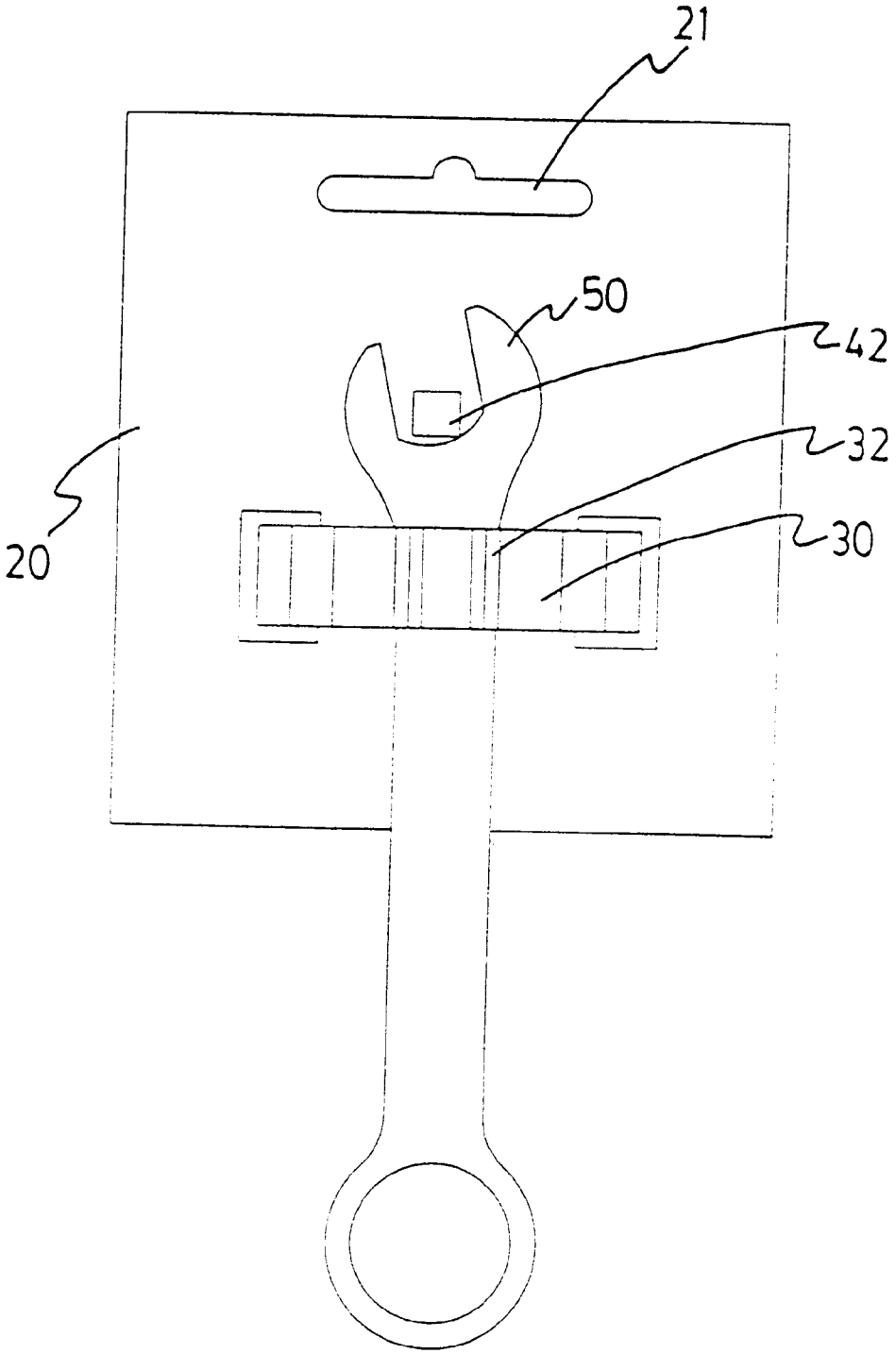
FIG. 3 is an illustrative view to show a wrench retained on the display rack of the present invention.

Referring to FIGS. 1 to 3, the tool display rack in accordance with the present invention comprises a board 20 having a slot 21 defined in a first end of the board 20 for hanging the tool display rack on a wall and two apertures 200 defined in a second end of the board 20. Two recesses 203 are defined in the board 20 and respectively communicate with the apertures 200. Two wall members 201 respectively extend from the board 20 on the opposite side where the two recesses 203 are defined, and each wall member 201 encloses the aperture 200 corresponding thereto so that a passage is defined in each wall member 201 and the passage communicates with the aperture 200. Each wall member 201 has a ridge 202 extending from an inside thereof.

A U-shaped retaining member 30 includes a bridge member 31 and two insertions 33 extending from two ends of the bridge member 31. The two insertions 33 each have a hole 330 defined therethrough. The two insertions 33 are able to be engaged with the two apertures 200 of the board 20, and the ridge 202 on each wall member 201 is engaged with the hole 330 in the insertion 33 corresponding thereto. Each insertion 33 has a flange 331 extending laterally outward therefrom so that the flanges 331 are engaged with the recesses 203 when the insertions 33 are inserted through the apertures 200.

It is to be noted that the bridge member 31 has two grooves 32 defined in the outside thereof so that when the display rack is bought by the user, he/she cut the bridge member 31 at the two grooves 32 to let the retaining member 30 become two parts 300 as shown in FIG. 2 so that the tool can be retained by the two parts 300 and easily removed between the two parts 300.

Referring to FIG. 3, at least one limitation member 42 extends from the board 20 and the limitation member 42 is located between the two jaws 50 so as to prohibit the wrench from rotating.

Figure 4:
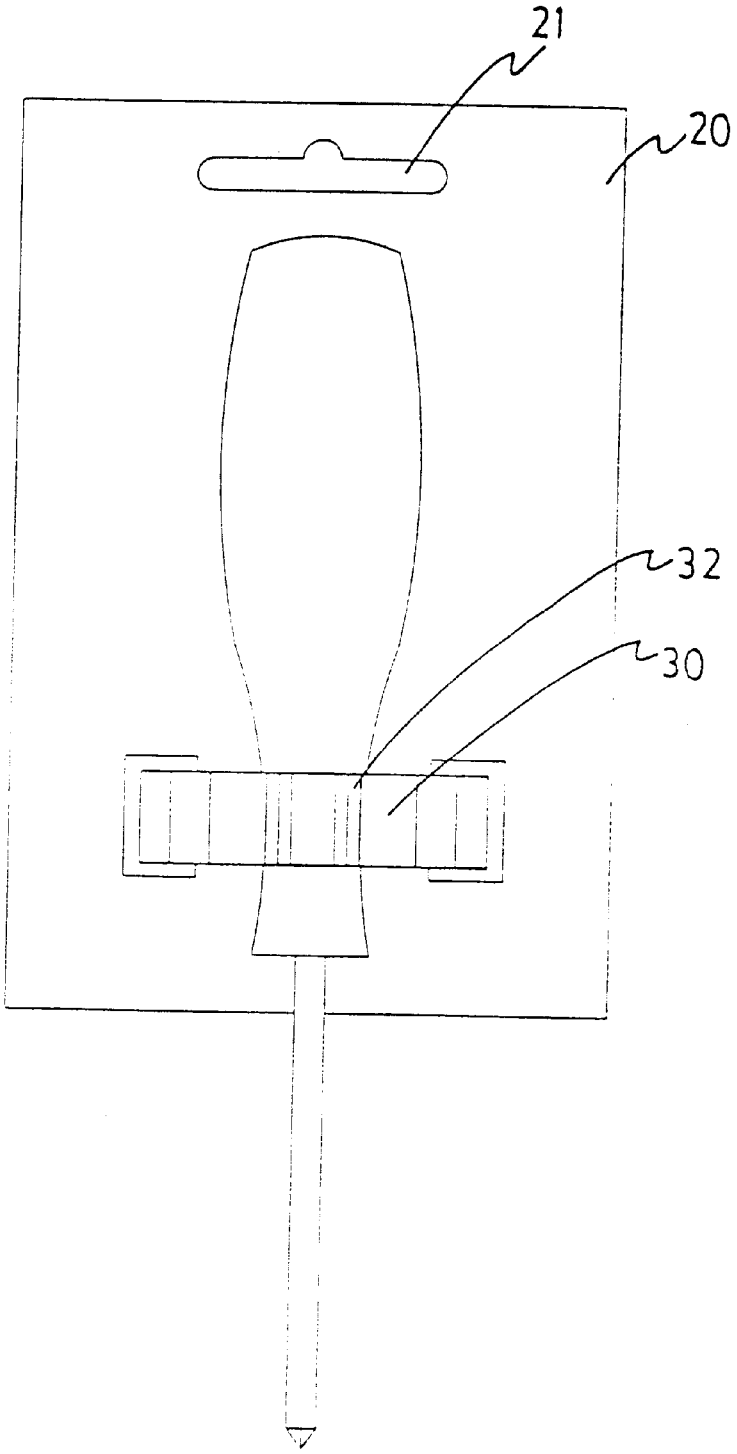
FIG. 4 is an illustrative view to show a screwdriver retained on the display rack of the present invention.
Figure 5:
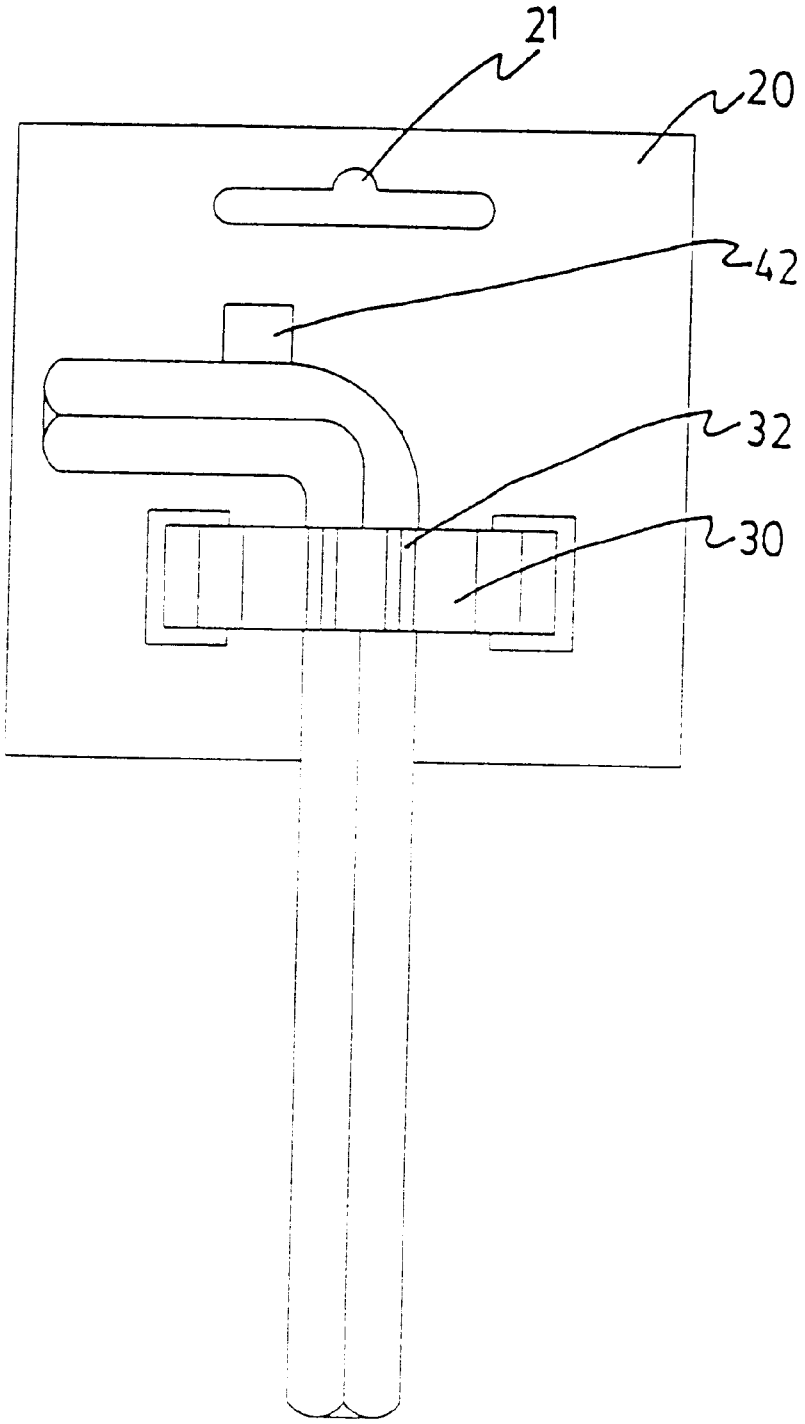
FIG. 5 is an illustrative view to show an Allen wrench retained on the display rack of the present invention.
Figure 6:
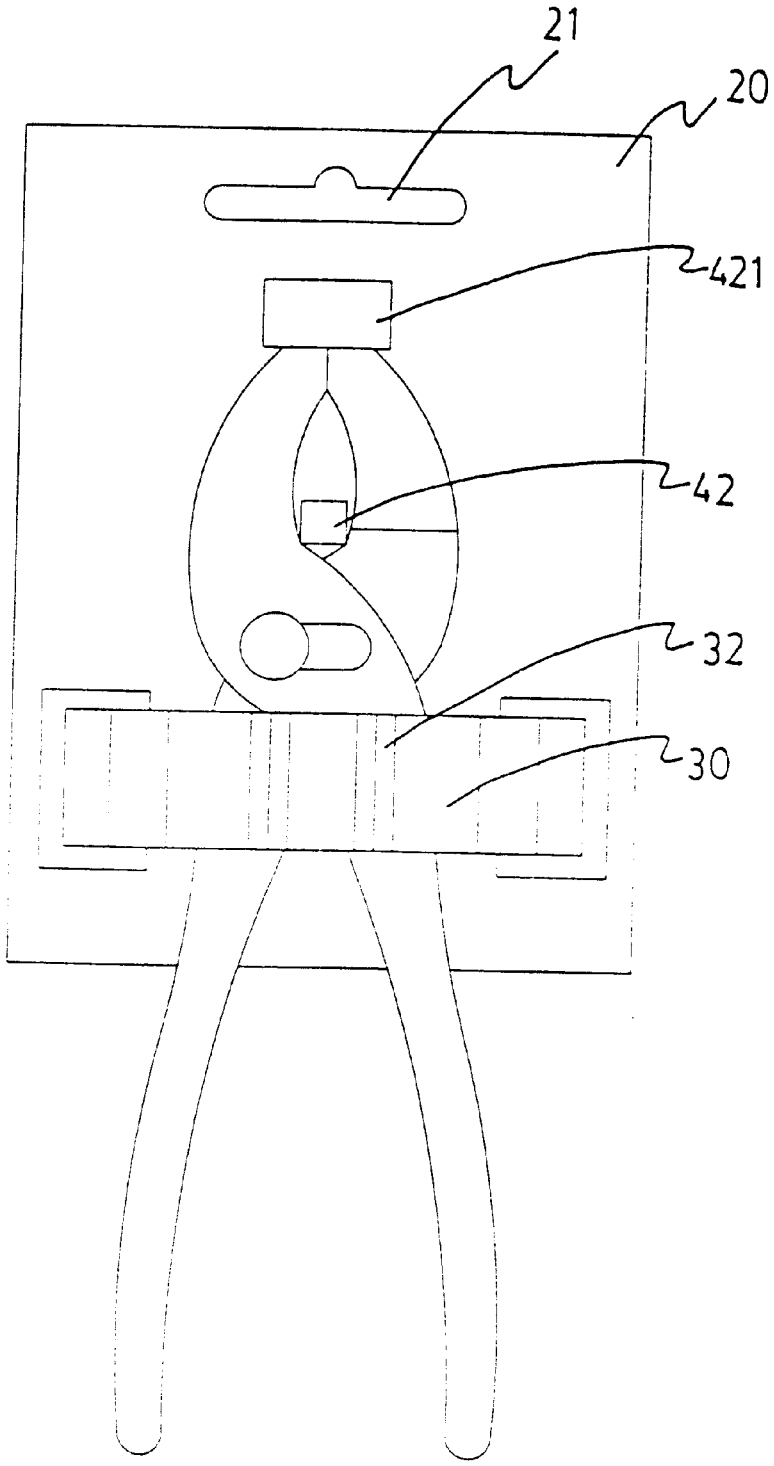
FIG. 6. is an illustrative view to show a pair of slip-joint pliers retained on the display rack of the present invention.
Figure 7:
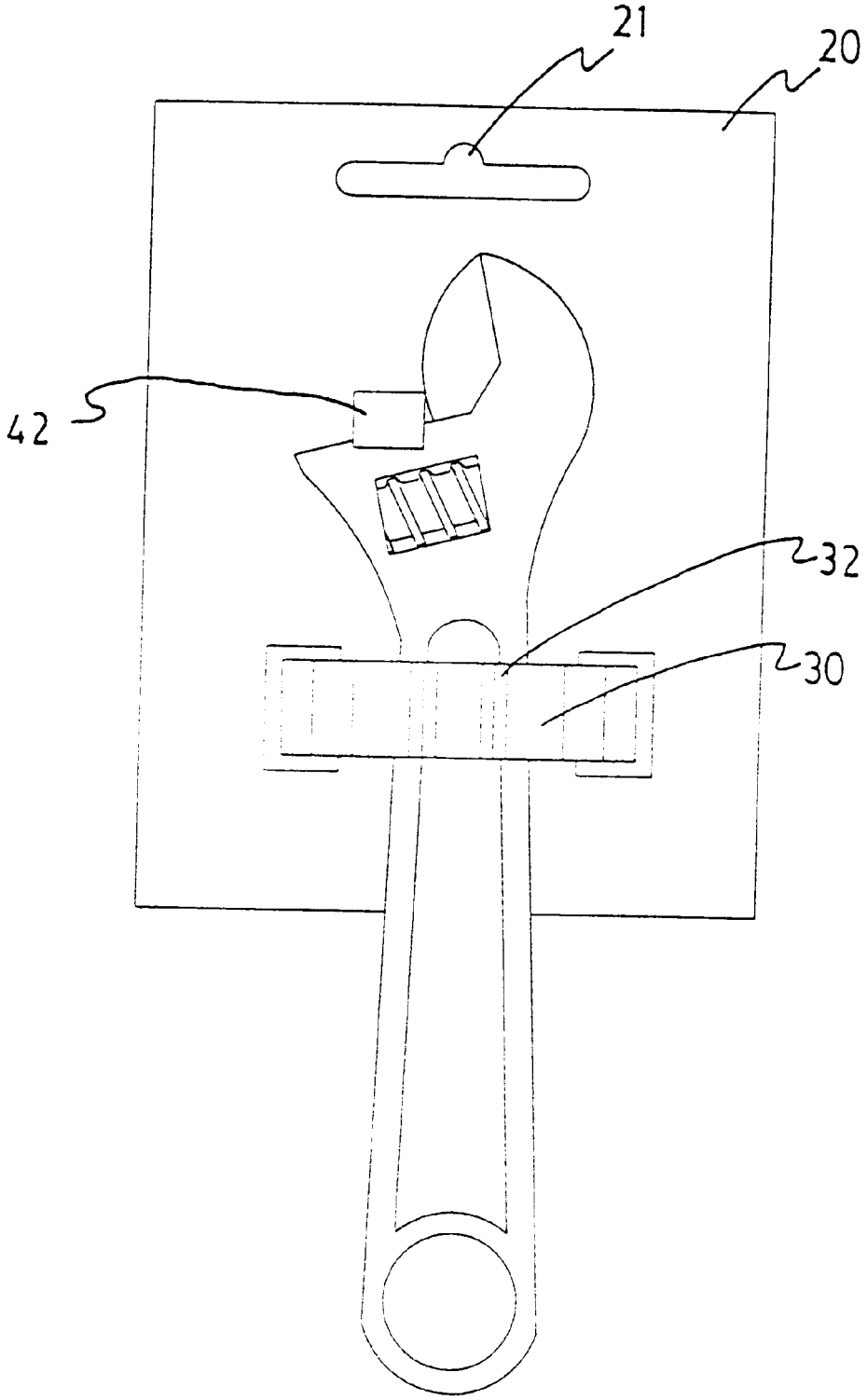
FIG. 7 is an illustrative view to show a pair of jaw-adjustable pliers retained on the display rack of the present invention.
Figure 8:
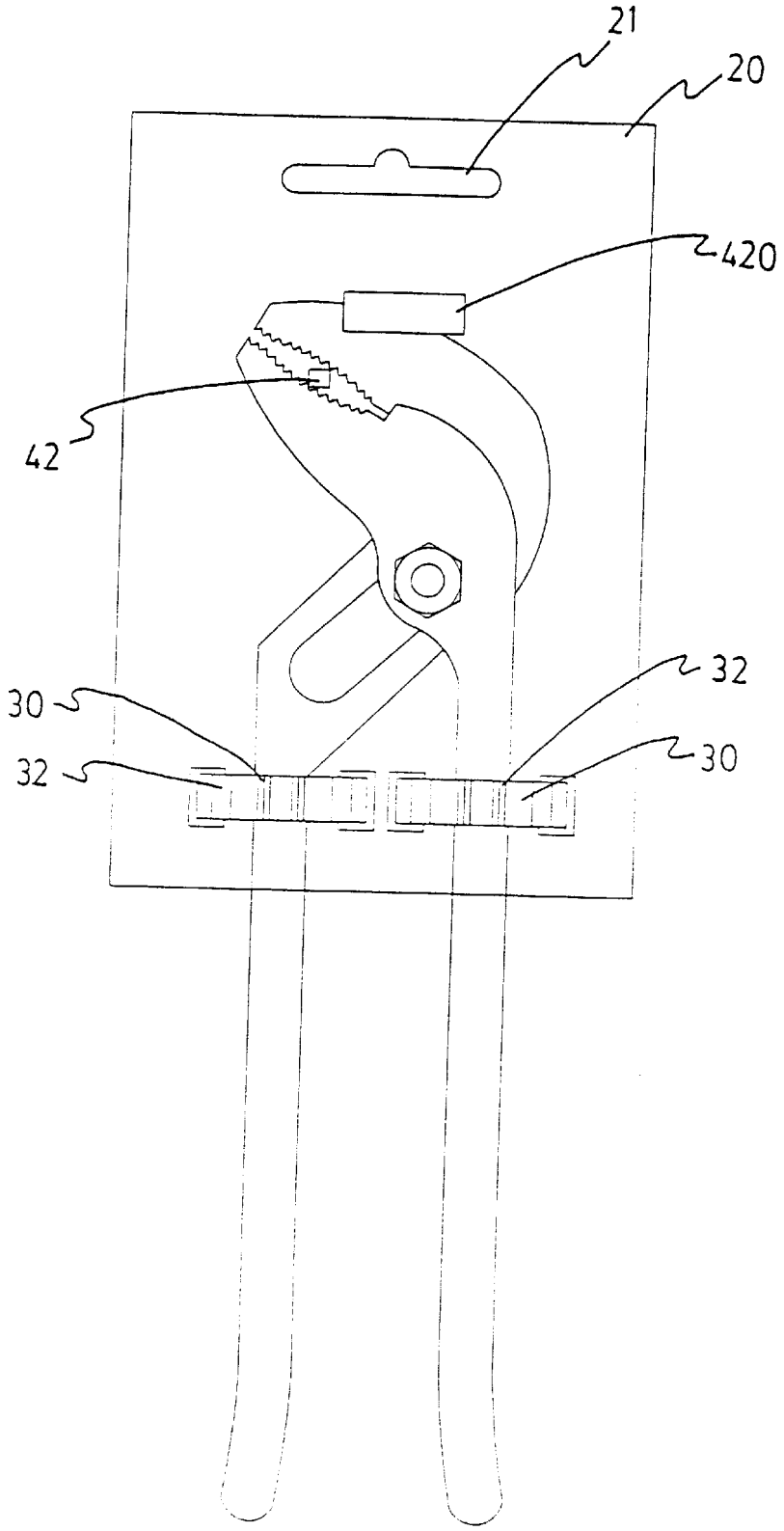
FIG. 8 is an illustrative view to show a pipe wrench retained on the display rack of the present invention.
Figure 9:
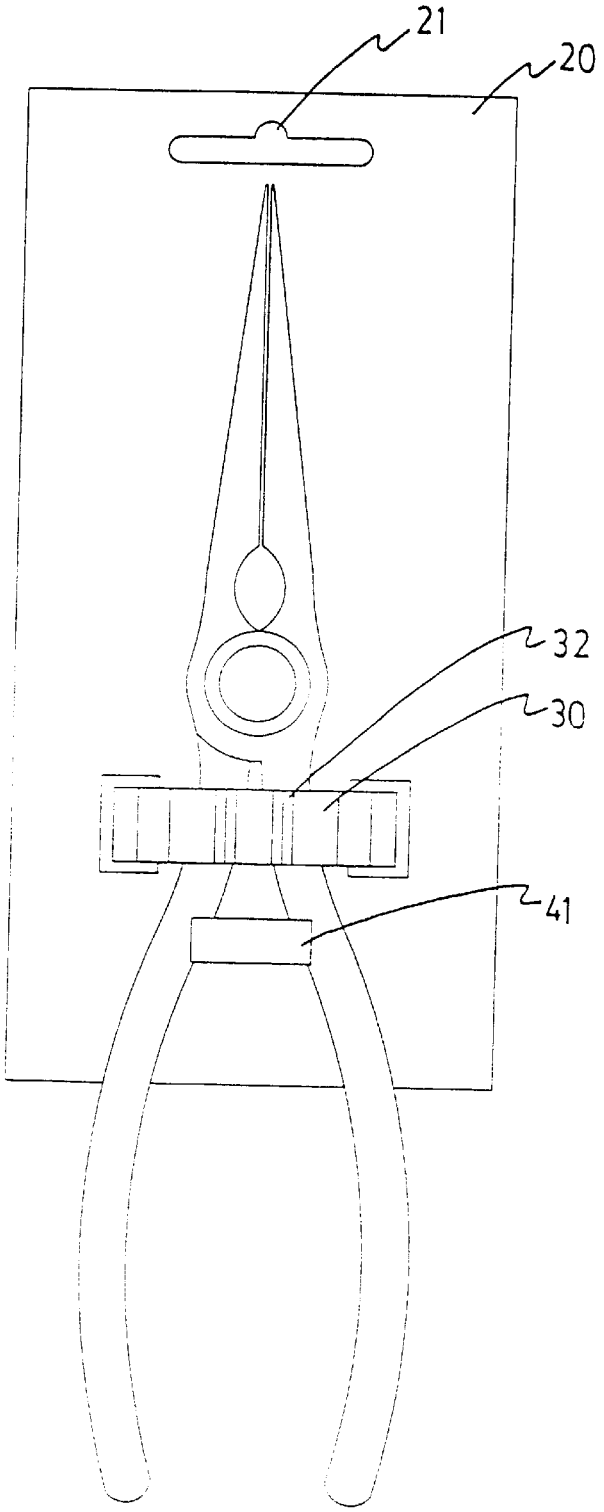
FIG. 9 is an illustrative view to show a pair of long-nose pliers retained on the display rack of the present invention.
Figure 10:
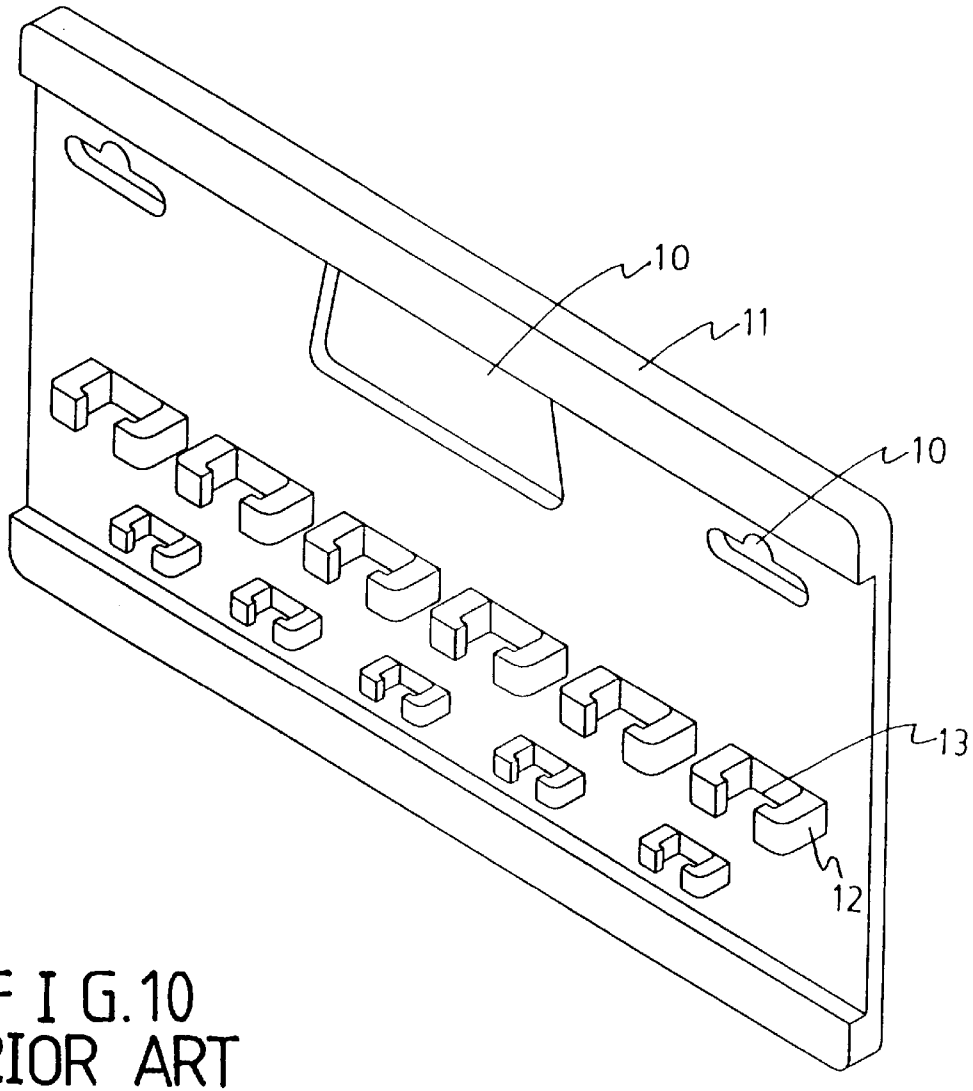
FIG.10 PRIOR ART
FIG. 10 is a perspective view to show a conventional tool display rack.

FIG. 4 shows a screwdriver that is retained on the display rack of the present invention by the retaining member 30. FIG. 5 shows an Allen wrench that is retained on the display rack of the present invention by the retaining member 30 and the limitation member 42 is located to contact a horizon portion of the Allen wrench to further secure the Allen wrench in position. FIG. 6 shows a pair of slip-joint pliers that are retained on the display rack of the present invention, wherein two limitation members 42, 421 are respectively located between the two jaws and the top of the pliers. FIG. 7 illustrates that a pair of jaw-adjustable pliers are retained on the display rack of the present invention and a limitation member 42 is located to prevent the pair of pliers from rotating. FIG. 8 shows that a pipe wrench are retained on the display rack of the present invention and two limitation members 42, 420 are located to position the pair of pliers. If the two handles of the pair of pliers are separated from each other at a distance, two retaining members 30 can be used to respectively retain the two handles. FIG. 9 illustrates a pair of long-nose pliers that are retained on the display rack of the present invention wherein the two handles are retained by a retaining member 30 and a limitation member 41 clamps the two handles on the board 20.

While we have shown and described various embodiments in accordance with the present invention, it should be clear to those skilled in the art that further embodiments may be made without departing from the scope and spirit of the present invention.

What is claimed is:

1. A tool display rack comprising:

a board having a slot and two apertures respectively defined through said board, and a U-shaped retaining member including a bridge member and two insertions extending from said bridge member, said two insertions engaged with said two apertures of said board, at least one groove defined in said bridge member and being transverse to a longitudinal axis of said bridge member, two wall members respectively extending from said board and each wall member enclosing a respective one of said apertures, each insertion having a hole defined therethrough and each wall member having a ridge extending therefrom so that said ridge are engaged with said holes in said insertions.

2. The tool display rack as claimed in claim 1 further comprising at least one limitation member extending from said board.

3. The tool display rack as claimed in claim 1 further comprising two recesses defined in said board and said two recesses respectively communicating with said apertures, each said insertion having a flange extending outward therefrom, said flanges engaged with said recesses.

* * * * *